US007314695B2

(12) United States Patent
Harada et al.

(10) Patent No.: US 7,314,695 B2
(45) Date of Patent: Jan. 1, 2008

(54) TONER FOR DEVELOPING ELECTROSTATIC CHARGE IMAGE

(75) Inventors: Yoshiaki Harada, Shizuoka (JP); Toru Nakamura, Abiko (JP)

(73) Assignees: Tomoegawa Paper Co., Ltd, Tokyo (JP); Ticona GmbH, Kelsterbach (DE)

( * ) Notice: Subject to any disclaimer, the term of this patent is extended or adjusted under 35 U.S.C. 154(b) by 387 days.

(21) Appl. No.: 10/510,978

(22) PCT Filed: Apr. 10, 2003

(86) PCT No.: PCT/JP03/04558

§ 371 (c)(1),
(2), (4) Date: Oct. 13, 2004

(87) PCT Pub. No.: WO03/087950

PCT Pub. Date: Oct. 23, 2003

(65) Prior Publication Data

US 2005/0106487 A1 May 19, 2005

(30) Foreign Application Priority Data

Apr. 15, 2002 (JP) ..... 2002-111618

(51) Int. Cl.
*G03G 9/087* (2006.01)

(52) U.S. Cl. ..... 430/108.22; 430/108.5; 430/109.3

(58) Field of Classification Search ..... 430/108.22, 430/108.5, 109.3
See application file for complete search history.

(56) References Cited

U.S. PATENT DOCUMENTS

| | | | | |
|---|---|---|---|---|
| 6,790,577 | B1 * | 9/2004 | Nakamura | 430/109.3 |
| 6,897,003 | B2 * | 5/2005 | Harada et al. | 430/109.3 |
| 2002/0042011 | A1 * | 4/2002 | Anno et al. | 430/108.1 |

FOREIGN PATENT DOCUMENTS

| | | |
|---|---|---|
| JP | A 5-9223 | 1/1993 |
| JP | A 5-339327 | 12/1993 |
| JP | A 6-271628 | 9/1994 |
| JP | A 11-305489 | 11/1999 |
| JP | A 2000-275905 | 10/2000 |
| JP | A-2000-284528 | 10/2000 |
| JP | A 2001-272816 | 10/2001 |

* cited by examiner

*Primary Examiner*—Christopher D. RoDee
(74) *Attorney, Agent, or Firm*—Antonelli, Terry, Stout & Kraus, LLP.

(57) ABSTRACT

A toner for developing electrostatic charge images that exhibits superior fixability at low temperature so as to realize satisfactory fixing performance even with less energy, that exhibits high stress resistance so as to be free from blade contamination by molten toner, and that exhibits excellent performances in any environmental conditions. In particular, a toner for developing an electrostatic charge images, comprising at least a binder resin, a colorant and a charge control agent, wherein a low-molecular-weight polymer having functional groups is used at least as the charge control agent and a cycloolefin copolymer resin is used at least as the binder resin.

14 Claims, No Drawings

TONER FOR DEVELOPING ELECTROSTATIC CHARGE IMAGE

TECHNICAL FIELD

The present invention relates to toners for developing electrostatic charge images, which are suitable for image forming apparatuses using electrophotographic technologies, such as copying machines, printers, facsimiles, etc., and in particular, relates to toners for developing electrostatic charge images which are suitable for image forming apparatuses using heat roller fixing systems.

BACKGROUND ART

Dry developers used in the development of image forming apparatuses using electrophotographic technology may be categorized in the two-component developer in which toner and carrier consisting of ferrite powder, iron powder, glass beads, etc., are mixed, the magnetic one-component developer in which magnetic powder is contained in the toner particles, and the nonmagnetic one-component developer which does not utilize magnetic force. Toners used in these developers comprise binder resins and colorants as main components, and waxes for improving low-temperature fixability on recording sheets and releasing properties from fixing rollers, and charge control agents for imparting charge (positive charge or negative charge), etc., are added in addition to the main components. The above materials are mixed at a predetermined ratio, and then the mixture is subjected to processing such as melting and kneading processing, pulverizing processing, classifying processing, etc., so as to produce toner powder, and may then be surface-treated with external additives such as silica, titania, alumina, and various fine resin particles in order to control fluidity, charging property, cleaning property, storage stability of the toner, etc., and a developer is finally provided.

Recently, in the image forming apparatuses as described above, multifunctionalization, speeding up of copying to spread in the boundary region between printing machines and copying machines, down sizing, and energy saving (saving in electric power consumption) primarily for saving costs, have been desired. According to these desires, simplification and energy saving in fixing systems such as heat roller fixing systems are required, and the characteristics of the toner which is adapted to the fixing systems as described above and which is adapted to speeding up of copying and long life durability of the developer are required. Therefore, in the toner, coexistence of two contradictory characteristics is required, that is, superior fixability should be obtained even by using small amounts of energy, and stress resistance such as resistance to toner melt contamination on a charging blade, etc., should be improved.

In order to satisfy such requirements, styrene-acrylic resin has primarily been used as a binder resin for toner up until now. However, in toners containing styrene-acrylic resin, although fixability is easily improved, and there is a problem of stress resistance reduction that the toner is easily crushed by friction with sleeves, etc., because the strength of the resin itself lowers when the improved fixability is obtained. Thus, polyester resin is widely used in order to make up for the insufficient stress resistance. However, in the toners containing polyester resin, charging amount is greatly changed in low-temperature and low-humidity environments, and the thickness of a toner layer on a sleeve is increased with increase of the charging amount, and as a result, problems of the excessive developing amount and the generation of background fogging occur, and therefore, toners having satisfactory qualities are not obtained under the present circumstances.

DISCLOSURE OF INVENTION

The present invention was made in order to solve such problems, and it is therefore an object of the present invention to provide a toner for developing electrostatic charge images in which sufficient fixability can be obtained even by small amounts of energy because of superior low-temperature fixability, blade contamination by molten toner or the like does not occur because of high stress resistance, and ability to withstand low-temperature and low-humidity environments is also superior.

A toner for developing electrostatic charge images of the present invention comprises at least binder resin, colorant, and charge control agent, wherein the charge control agent comprises low molecular weight polymer having functional groups, and the binder resin comprises cycloolefin copolymer resin.

According to the toner for developing electrostatic charge images of the present invention, stress resistance and ability to withstand environmental conditions are improved by using at least cycloolefin copolymer resin as a binder resin, and superior low-temperature fixability is demonstrated while retaining sufficient charge by using at least a low molecular weight polymer having functional groups as a charge control agent. Accordingly even if a large number of sheets is continuously copied under environmental conditions such as high-temperature and high-humidity or low-temperature and low-humidity, sufficient image density is obtained, and problems such as fogging, blade contamination, generation of offset, etc., are not produced. Furthermore, the low molecular weight polymers having functional groups also have effects that non-offset temperature at the lower side of the toner of the present invention decreases.

In addition, production of cycloolefin copolymer resin, used in the present invention as a binder resin, is superior in view of environmental problems, because solvents and endocrine-disrupting chemicals (environmental hormonal substances) used in production of styrene-acrylic resins and polyester resins are not used. Furthermore, the toners for developing electrostatic charge images of the present invention is extremely superior in view of environmental problems, since low molecular weight polymer having functional groups in the present invention does not have a structure including metal complexes as is the case in conventional charge control agents and is a charge control agent of the polymer type which does not contain heavy metals such as chromium, etc.

The toner for developing electrostatic charge images of the present invention contains cycloolefin copolymer resin which is a binder resin, low molecular weight polymer having functional groups which is a charge control agent, and colorant, as essential constituent materials, and low-melting-point wax and other additives, etc., can be appropriately added as necessary in addition to the above essential constituent materials. These materials are mixed at a predetermined mixing ratio, and they are subjected to treatments such as melting and kneading processing, pulverizing processing, and classifying processing, so as to form toner particles, and then the toner particles are mixed with external additives so that the external additives adhere to the surface of the toner particles, and a toner for developing electrostatic charge images of the present invention is thereby produced. The toner of the present invention obtained in this way can be used as a nonmagnetic one-component developer, or as a two-component developer by using a carrier, and in addition, it can be used as a magnetic one-component developer by containing magnetic powder. In the following, these preferable materials will be explained in detail.

The cycloolefin copolymer resin is a polyolefin resin having a cyclic structure, and for example, it may be a copolymer of an α-olefin such as ethylene, propylene, butylenes, etc., and alicyclic compounds having double bonds such as cyclohexene, norbornene, tetracyclo dodecene, etc., and it may be any random copolymer or block-copolymer. The polyolefin resin having a cyclic structure can be obtained by well-known polymerization methods using a metallocene-type or Ziegler-type catalyst. For example, it can be synthesized by methods described in Japanese Unexamined Patent Application Publication No. 5-339327, Japanese Unexamined Patent Application Publication No. 5-9223, Japanese Unexamined Patent Application Publication No. 6-271628, etc.

Copolymerization ratio of an α-olefin and a cycloolefin in the cycloolefin copolymer resin can be widely changed by properly setting feeding mole ratios of both monomers during the reaction so as to obtain desired resins, and specifically, the mixing ratio of cycloolefin to the total of both olefins is set at 2 to 98 mol %, preferably 2.5 to 50 mol %, and more preferably 2.5 to 35 mol %. For example, in the case in which ethylene as an α-olefin and norbomene as a cycloolefin are reacted, the glass transition point (Tg) of the cycloolefin copolymer resin which is a reaction product is greatly influenced by the feeding ratio of these olefins, and when the feeding ratio of norbornene is increased, Tg tends to also increase. Specifically, the Tg of produced resin is 60 to 70° C. when the feeding ratio of norbornene is about 60 weight %.

In the present invention, it is preferable that the above cycloolefin copolymer resin have at least two peaks in the molecular weight distribution thereof as measured by gel permeation chromatography (hereafter referred to as "GPC"). The cycloolefin copolymer resin may be a mixture of a low molecular weight fraction and a high molecular weight fraction, or it may be prepared by controlling synthesis conditions so that the low molecular weight fraction and the high molecule fraction have at least a peak in the molecular weight distribution measured by GPC, respectively. In addition, number average molecular weight (hereafter referred to as "Mn") of the low molecular weight fraction is less than 7,500, Mn of the high molecular weight fraction is 7,500 or more, and the mixing ratio of the high molecular weight fraction is preferably 5 to 50 weight % in binder resin, and it is more preferably 5 to 30 weight %. When the mixing ratio of the high molecular weight fraction exceeds 50 weight %, the degree of uniform kneading is extremely decreased and problems occur in toner performance, and sufficient fixing strength cannot be obtained in low-temperature fixing. In contrast, when it is less than 5 weight %, sufficient non-offset temperature width cannot be obtained.

Here, "fraction" is defined as each resin component before mixing in the case in which the cycloolefin copolymer resin consists of a mixture of resin components having different Mn, and it is defined as resin components of portions having each peak divided by a boundary which is a lowest point between two peaks in the molecular weight distribution thereof as measured using a GPC method in the case in which the cycloolefin copolymer resin consists of a single resin component copolymerized by synthesis.

In the present invention, the cycloolefin copolymer resin containing a low molecular weight fraction of which Mn is less than 7,500 and a high molecular weight fraction of which Mn is 7,500 or more at the above mixing ratio is preferably used, and Mn of the low molecular weight fraction is more preferably 1,000 to less than 7,500 and it is most preferably 3,000 to less than 7,500, and Mn of the high molecular weight fraction is more preferably 7,500 to 1,000,000, and it is most preferably 50,000 to 700,000. In addition, weight average molecular (hereinafter referred to as "Mw") of the low molecular weight fraction is preferably less than 15,000, and it is more preferably 1,000 to less than 15,000, and it is most preferably 4,000 to less than 15,000, and in contrast, Mw of the high molecular weight fraction is preferably 15,000 or more, and it is more preferably 100,000 to 1,500,000.

Furthermore, carboxyl groups may be introduced in the cycloolefin copolymer resin in the present invention by a fusing air oxidation method or maleic anhydride modification, etc. Compatibility with other resins and dispersibility of pigments can be thereby improved. In addition, similar effects can be obtained by introducing hydroxyl groups and amino groups using well-known methods. Furthermore, fixability can be improved by introducing a crosslinked structure by copolymerizing diene monomers such as norbomadiene, cyclohexadiene, tetracyclo dodecadiene, etc., in cycloolefin copolymer resin, or by adding a metal such as zinc, copper, calcium, etc., to a cycloolefin copolymer resin having carboxyl groups.

In the present invention, other resins may be used as the binder resin in addition to the above cycloolefin copolymer resin. In this case, the mixing ratio of cycloolefin copolymer resin in the binder resin is preferably 20 to 100 weight %, and it is more preferably 50 to 100 weight %. When cycloolefin copolymer resin is less than 20 weight %, image density cannot be sufficiently maintained under any environmental conditions in the case of continuously copying of a large number of sheets, and problems such as fogging and toner dusting tend to occur.

As other resins which can be used in combination with cycloolefin copolymer resin, polystyrene resin, polyacrylic ester resin, styrene-acrylate copolymer resin, styrene-methacrylate copolymer resin, polyvinylchloride, polyvinyl acetate, polyvinylidene chloride, phenol resin, epoxy resin, polyester resin, etc., can be used, and in particular, in order to improve the fixing performance of the toner, it is preferable that the melting start temperature (softening point) thereof be as low as possible (for example, 120 to 150° C.), and in order to improve the storage stability, it is preferable that the glass transition point thereof be 65° C. or more.

A charge control agent is added in order to impart charge, and in the toner of the present invention, it is necessary that the charge control agent be at least a low molecular weight polymer having the functional group, and the Mn thereof be preferably 1,000 to 10,000, and more preferably 1,000 to 7,000, and most preferably 1,000 to 5,000. When Mn is less than 1,000, storage stability as a developer is decreased. In addition, offset easily occur in fixing. In contrast, when Mn exceeds 10,000, compatibility with binder resin is deteriorated, and uniform dispersing is not obtained, and fogging, photo receptor contamination, poor fixing, etc., would be thereby generated. In addition, an effect of low-temperature fixing is also not obtained.

As such low molecular weight polymers, specifically, for example, positive-charge type styrene-acrylic resins in which quaternary ammonium salt type functional groups are added to a main chain as shown in the following chemical formula 1, and negative-charge type styrene-acrylic resins in which sulfonic acid type functional groups are added to a main chain as shown in chemical formula 2, etc., can be used. Such charge control agents of the polymer type are superior in view of environmental problems since they do not have a structure including metal complexes which conventional ones have. In addition, in the toner of the present invention, well-known common charge control agents can be used in combination with the low molecular weight polymers having functional groups, so long as the effects of the present invention are not prevented. Furthermore, the mixing amount of the low molecular weight polymer in the toner of the present invention is preferably 1 to 15 weight parts to binder resin of 100 weight parts, and it is more preferably 2 to 13 weight parts. When the mixing ratio of the low molecular weight polymer is less than 1 weight part, the necessary electrostatic charge amount is not obtained, and problems, of that unevenness of electrostatic charge amount occurs among toner particles, the fixed image is not clear, and photo receptor contamination is increased, are easily generated. In contrast, when the mixing ratio exceeds 15 weight parts, the electrostatic charge is poor due to reduced ability to withstand environmental conditions and compatibility in binder resins, etc., and fogging is easily generated.

Chemical formula 1

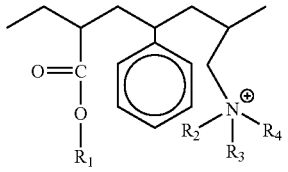

($R_1$ represents an alkyl group and $R_2$ to $R_4$ represent a hydrogen atom or an alkyl group in the chemical formula.)

Chemical formula 2

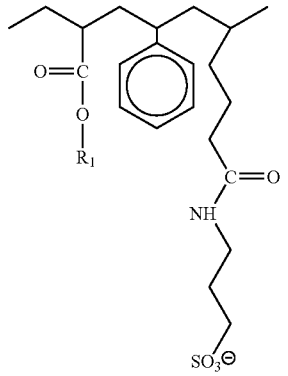

($R_1$ represents an alkyl group in the chemical formula.)

As a colorant, well-known colorants such as carbon black, aniline blue, chalcoil blue, chrome yellow, ultramarine blue, Dupont oil red, quinoline yellow, methylene blue chloride, phthalocyanine blue, malachite green oxalate, lamp black, rose Bengal, etc., either by the single use or by the mixture of two kinds or more, can be used. It is necessary that the colorant be contained in sufficient amount to form visible images having sufficient density, and for example, the colorant may be contained in 1 to 20 weight parts to binder resin of 100 weight parts.

As other additives which may be contained, as necessary, magnetic powders, waxes, etc., can be used.

As a magnetic powder, fine particles such as ferrite powder, magnetite powder, iron powder, etc., can be used. As a ferrite powder, mixed sintered material of MeO—$Fe_2O_3$ can be used in the present invention. In this case, MeO means oxides such as those of Mn, Zn, Ni, Ba, Co, Cu, Li, Mg, Cr, Ca, V, etc., and one kind or more thereof can be used. In addition, as a magnetite powder, mixed sintered material of FeO—$Fe_2O_3$ can be used. It is preferable that the magnetic powder have a particle size of 0.05 to 3 μm, and it is preferable that the mixing ratio thereof in the toner be 70 weight % or less.

The wax is added in order to improve low-temperature fixability by decreasing the melting start temperature of the toner, or as a release agent, and synthetic waxes, petroleum waxes, etc., can be used. As a synthetic wax, polypropylene wax, Fischer-Tropsch wax, etc., can be used, and as a petroleum wax, paraffin wax, microcrystalline wax, petrolatum, etc., can be used. Furthermore, as other waxes, natural waxes such as carnauba wax, rice wax, candelilla wax, etc., can be used. In addition, the above waxes may be used in combination as necessary.

The above materials are mixed at a predetermined ratio, and then the mixture is subjected to processing such as melting and kneading processing, pulverizing processing, classifying processing, etc., and, toner particles composing the toner of the present invention can thereby be produced. In addition, the toner particles may be produced by polymerization methods using raw materials of the above materials. Volume average particle size of the toner particles is generally set within 5 to 15 μm.

In the toner of the present invention, it is preferable to adhere an external additive thereon in order to control fluidity, charging property, cleaning property, storage stability of the toner, etc. As external additives, silica, alumina, talc, clay, calcium carbonate, magnesium carbonate, titania, magnetic powder, or various fine resin particles can be used, and in particular, hydrophobic silica is preferable in the present invention. In addition, many kinds thereof may be used in combination as necessary. These external additives are added by post-addition at 0.3 to 3 weight parts to the above toner particles of 100 weight parts. Furthermore, a surface treatment with the external additive can use common mixing machines such as turbine agitaters, Henschel mixers, super mixers, etc.

BEST MODE FOR CARRYING OUT THE INVENTION

In the following, effects of the present invention are explained by Examples and Comparative Examples based on the present invention. However, the present invention is not limited by these embodiments.

1. Preparation of Toner for Developing Electrostatic Charge Images

EXAMPLE 1

Cycloolefin Copolymer Resin

Ethylene-norbornene copolymer resin A (trade name: TOPAS COC, produced by Ticona GmbH, Mn: 5,020, Mw: 138,000, Mw/Mn: 27.5, Mn of low molecular weight fraction: 4,080, Mw thereof: 7,960, Mn of high molecular weight fraction: 291,300, Mw thereof: 703,400, and high molecular weight fraction/low molecular weight fraction: 18.5/81.5), 100 weight parts Charge Control Agent Low molecular weight polymer (trade name: FCA-1001-NS (anionic type), produced by Fujikura Kasei Co., Ltd., Mn: 3,730, and Mw: 7,970), 5 weight parts Polypropylene wax (trade name: Viscol 550P, produced by Sanyo Chemical Industries Ltd.), 3 weight parts Carbon black (trade name: MA-100, produced by Mitsubishi Chemical Corporation), 7 weight parts Raw materials in the above component ratio were mixed by a supermixer, were heat-melted and kneaded by a biaxial extruder at a temperature of 140° C., were pulverized by a jet mill, and then were classified by a dry-type air flow classifier, and toner particles having volume average particle size of 9 μm were thereby obtained. Next, hydrophobic silica (trade name: R-972, produced by Nippon Aerosil Co., Ltd.) was added so that the adhered amount relative to the obtained toner particles was 0.5 weight %, and the toner for developing electrostatic charge images of Example 1 was produced by mixing at a peripheral speed of 40 m/sec for 8 minutes using a Henschel mixer.

The above Mn and Mw of the cycloolefin copolymer resin and low molecular weight polymer are values measured by GPC under the following conditions. That is, the measurement was carried out by flowing tetrahydrofuran (THF) at a flow velocity of 1 ml/min at a column temperature of 40° C. using polystyrene as a standard, and then the measured value was converted into a polystyrene equivalent.

EXAMPLE 2

Toner for developing electrostatic charge images of Example 2 was produced in the same manner as that of Example 1, except for using ethylene-norbornene copolymer resin B (trade name: TOPAS COC, produced by Ticona GmbH, Mn: 4,250, Mw: 96,100, Mw/Mn: 22.6, Mn of low molecular weight fraction: 3,630, Mw thereof: 6,790, Mn of high molecular weight fraction: 309,100, Mw thereof: 683,800, and high molecular weight fraction/low molecular weight fraction: 12.5/87.5) instead of cycloolefin copolymer resin A of Example 1. The above Mn and Mw of cycloolefin copolymer resin are values measured by GPC under the same conditions as that of Example 1.

EXAMPLE 3

Toner for developing electrostatic charge images of Example 3 was produced in the same manner as that of Example 1, except for using 10 weight parts of low molecular weight polymer of Example 1.

EXAMPLE 4

Toner for developing electrostatic charge images of Example 4 was produced in the same manner as that of Example 1, except for using a low molecular weight polymer (trade name: FCA2-01-PS, produced by Fujikura Kasei Co., Ltd., cationic type, Mn: 1,560, and Mw: 3,340) instead of the low molecular weight polymer of Example 1. The above Mn and Mw of low molecular weight polymer are values measured by GPC under the same conditions as that of Example 1.

EXAMPLE 5

Toner for developing electrostatic charge images of Example 5 was produced in the same manner as that of Example 4, except for using 10 weight parts of the low molecular weight polymer of Example 4.

COMPARATIVE EXAMPLE 1

Toner for developing electrostatic charge images of Comparative Example 1 was produced in the same manner as that of Example 1, except for using polyester resin (trade name: FC-316, produced by Mitsubishi Rayon Co., Ltd.) as a binder resin, instead of the cycloolefin copolymer resin A of Example 1.

COMPARATIVE EXAMPLE 2

Toner for developing electrostatic charge images of Comparative Example 2 was produced in the same manner as that of Example 1, except for using styrene acrylate copolymer resin (trade name: CPR-100, produced by Mitsui Chemicals, Inc.) as a binder resin, instead of the cycloolefin copolymer resin A of Example 1.

COMPARATIVE EXAMPLE 3

Toner for developing electrostatic charge images of Comparative Example 3 was produced in the same manner as that of Example 1, except for using a charge control agent (trade name: T-77, produced by Hodogaya Chemical Co., Ltd.) instead of the charge control agent of Example 1. This charge control agent is a ferrous complex and is not a low molecular weight polymer.

COMPARATIVE EXAMPLE 4

Toner for developing electrostatic charge images of Comparative Example 4 was produced in the same manner as that of Example 1, except for using a charge control agent (trade name: TN-105, produced by Hodogaya Chemical Co., Ltd.) instead of the charge control agent of Example 1. This charge control agent is a molybdic complex and is not a low molecular weight polymer.

COMPARATIVE EXAMPLE 5

Toner for developing electrostatic charge images of Comparative Example 5 was produced in the same manner as that of Example 1, except for using a charge control agent (trade name: Bontron N-04, produced by Orient Chemical Industries, Ltd.) instead of the charge control agent of Example 1. This charge control agent is a resin acid modified azine compound and is not a low molecular weight polymer.

COMPARATIVE EXAMPLE 6

Toner for developing electrostatic charge images of Comparative Example 6 was produced in the same manner as that of Example 4, except for using a polyester resin (trade name: FC-316, produced by Mitsubishi Rayon Co., Ltd.) as a binder resin, instead of the cycloolefin copolymer resin A of Example 4.

COMPARATIVE EXAMPLE 7

Toner for developing electrostatic charge images of Comparative Example 7 was produced in the same manner as that of Example 4, except for using a styrene acrylate copolymer resin (trade name: CPR-100, produced by Mitsui Chemicals, Inc.) as a binder resin, instead of the cycloolefin copolymer resin A of Example 4.

2. Evaluation of Characteristics

The toners for developing electrostatic charge images of Examples 1 to 3 and Comparative Examples 1 to 4 were put into a commercial printer of the nonmagnetic one-component development system for using a negative chargeable toner, and the toners for developing electrostatic charge images of Examples 4 to 5 and Comparative Examples 5 to 7 were put into a commercial printer of nonmagnetic one-component development system for using a positive chargeable toner. An A4 size original having a black ratio of 6% was continuously copied on 10,000 sheets of A4 paper, while the above toners decreased by use were replenished, respectively. The copying was carried out under different environmental conditions, such as normal temperature and normal humidity (20° C. and 58% RH), high-temperature and high-humidity (32° C. and 85% RH), and low-temperature and low-humidity (10° C. and 20% RH). Image density and fogging in a non-image portion in a first sheet under normal temperature and normal humidity and in the 10,000th sheet under each environmental condition were measured, and in addition, existence of blade contamination by molten toner was observed at the same time. These evaluated results are shown in Table 1.

Image density was evaluated by measuring a solid image using a reflection density meter (trade name: RD-914, produced by Aretag Macbeth LLC.), and fogging was measured by a colorimetry and color-difference meter (trade name: ZE 2000, produced by Nippon Denshoku Industries Co., Ltd.). In addition, in connection with the existence of blade contamination by molten toner, transferred images were examined by visually, and the existence of stripes due to the blade contamination by molten toner was confirmed. For toners in which blade cotamination occurred, an asterisk is appended after measured values of image density and fogging in Table 1.

An external fusing unit which can be changed speed and temperature was produced by removing only a fusing unit from a commercial copying machine (trade name: SF-2035, produced by Sharp Corporation). Then, non-offset temperature at the lower side of each toner for developing electrostatic charge images of Examples and Comparative Examples was measured at a processing speed of 90 mm/sec using this external fusing unit. These evaluated results are shown in Table 1.

As is apparent from the results in Table 1, in the toners for developing electrostatic charge images of the Examples 1 to 5 which contain cycloolefin copolymer resins and low molecular weight polymers having functional groups, image density and fogging of the first sheet and the 10,000th sheet under each environmental condition were within a range in which there is no problem in practical use, and in addition, the blade contamination by molten toner was not at all generated. Additionally, non-offset temperature at the lower side could be drastically reduced particularly in Example 5. In contrast, in the Comparative Examples 1 and 6 using polyester resin instead of cycloolefin copolymer resin, image density was deteriorated under high-temperature and high-humidity, fogging was remarkably generated under low-temperature low-humidity, and furthermore, non-offset temperature at the lower side was also considerably high. In addition, in the Comparative Examples 2 and 7 using styrene acrylate copolymer resin instead of cycloolefin copolymer resin, blade contamination by molten toner was generated under any condition, and non-offset temperature at the lower side was also high. Furthermore, in the Comparative Examples 3 to 5 which did not use a charge control agent as specified in the present invention, image density and fogging under each environmental condition were good; however, non-offset temperature at the lower side was still high.

TABLE 1

| | First Sheet | | 10,000th Sheet under normal temperature and normal humidity | | 10,000th Sheet under high temperature and high humidity | | 10,000th Sheet under low temperature and low humidity | | | Non-offset temperature |
|---|---|---|---|---|---|---|---|---|---|---|
| | Image Density | Fogging | Image Density | Fogging | Image Density | Fogging | Image Density | Fogging | Blade Contamination | at Lower side (° C.) |
| Example 1 | 1.41 | 0.83 | 1.39 | 0.65 | 1.39 | 0.51 | 1.40 | 0.62 | ○ | 140 |
| Example 2 | 1.43 | 0.52 | 1.40 | 0.65 | 1.38 | 0.47 | 1.42 | 0.59 | ○ | 135 |
| Example 3 | 1.40 | 0.60 | 1.38 | 0.48 | 1.40 | 0.44 | 1.41 | 0.67 | ○ | 130 |
| Example 4 | 1.35 | 0.53 | 1.38 | 0.62 | 1.34 | 0.39 | 1.36 | 0.48 | ○ | 135 |
| Example 5 | 1.34 | 0.50 | 1.35 | 0.53 | 1.36 | 0.50 | 1.37 | 0.55 | ○ | 125 |
| Comparative Example 1 | 1.43 | 0.53 | 1.38 | 0.62 | 1.29 | 0.24 | 1.48 | 1.56 | ○ | 160 |
| Comparative Example 2 | 1.42 | 0.80 | 1.40* | 0.80* | 1.38* | 0.61* | 1.40* | 0.55* | X | 155 |
| Comparative Example 3 | 1.41 | 0.35 | 1.40 | 0.45 | 1.39 | 0.55 | 1.41 | 0.70 | ○ | 150 |
| Comparative Example 4 | 1.40 | 0.62 | 1.41 | 0.68 | 1.38 | 0.53 | 1.41 | 0.65 | ○ | 150 |
| Comparative Example 5 | 1.35 | 0.62 | 1.36 | 0.59 | 1.35 | 0.39 | 1.37 | 0.62 | ○ | 150 |
| Comparative Example 6 | 1.36 | 0.55 | 1.36 | 0.49 | 1.33 | 0.39 | 1.44 | 1.42 | ○ | 155 |
| Comparative Example 7 | 1.34 | 0.49 | 1.32* | 0.58* | 1.38* | 0.58* | 1.31* | 0.49* | X | 155 |

The invention claimed is:

1. A toner for developing electrostatic charge images comprising at least binder resin, colorant, and charge control agent, wherein the charge control agent comprises a low molecular weight polymer selected from the group consisting of a positive charge-type low molecular weight polymer in which quaternary ammonium salt type functional groups are added to a styrene-acrylic main chain and a negative charge-type low molecular weight polymer in which sulfonic acid type functional groups are added to a styrene-acrylic main chain, and the binder resin comprises ethylene-norbornene copolymer resin having at least two peaks in molecular weight distribution measured by gel permeation chromatography and comprises a high molecular weight fraction having number average molecular weight of 7,500 or more at 5 to 50 weight % to the binder resin, and Mw/Mn is 22.6 to 27.5, wherein Mw is the weight average molecular weight of the ethylene-norbornene copolymer resin and Mn is the number average molecular weight of the ethylene-norbornene copolymer resin.

2. The toner for developing electrostatic charge images according to claim 1, wherein the low molecular weight polymer has a number average molecular weight of 1,000 to 10,000.

3. The toner for developing electrostatic charge images according to claim 1, wherein the low molecular weight polymer is mixed at 1 to 15 weight parts to the binder resin of 100 weight parts.

4. The toner for developing electrostatic charge images according to claim 1, wherein a mixing ratio of the high molecular weight fraction having number average molecular weight of 7,500 or more is 5 to 30 weight % in the binder resin.

5. The toner for developing electrostatic charge images according to claim 1, wherein the ethylene-norbornene copolymer resin comprises the high molecular weight fraction having number average molecular weight of 7,500 or more and a low molecular weight fraction having number average molecular weight of less than 7,500.

6. The toner for developing electrostatic charge images according to claim 1, wherein the high molecular weight fraction has a number average molecular weight of 7,500 to 1,000,000 and the low molecular weight fraction has a number average molecular weight of 1,000 to 7,500.

7. The toner for developing electrostatic charge images according to claim 1, wherein the high molecular weight fraction has a number average molecular weight of 50,00 to 700,000 and the low molecular weight fraction has a number average molecular weight of 3,000 to 7,500.

8. The toner for developing electrostatic charge images according to claim 1, wherein the high molecular weight fraction has a weight average molecular weight of 15,000 or more and the low molecular weight fraction has a weight average molecular weight of less than 15,000.

9. The toner for developing electrostatic charge images according to claim 1, wherein the high molecular weight fraction has a weight average molecular weight of 100,000 to 1,500,000 and the low molecular weight fraction has a weight average molecular weight of 1,000 to 15,000.

10. The toner for developing electrostatic charge images according to claim 1, wherein the high molecular weight fraction has a weight average molecular weight of 100,000 to 1,500,000 and the low molecular weight fraction has a weight average molecular weight of 4,000 to 15,000.

11. The toner for developing electrostatic charge images according to claim 1, wherein the ethylene-norbornene copolymer resin comprises 20 to 100 weight % of the binder resin.

12. The toner for developing electrostatic charge images according to claim 1, wherein the ethylene-norbornene copolymer resin comprises 50 to 100 weight % of the binder resin.

13. The toner for developing electrostatic charge images according to claim 1, wherein the low molecular weight polymer has a number average molecular weight of 1,000 to 7,000.

14. The toner for developing electrostatic charge images according to claim 1, wherein the low molecular weight polymer has a number average molecular weight of 1,000 to 5,000.

* * * * *